US011209743B2

(12) United States Patent
Tsukahara

(10) Patent No.: US 11,209,743 B2
(45) Date of Patent: Dec. 28, 2021

(54) IMAGE FORMING APPARATUS

(71) Applicant: CANON KABUSHIKI KAISHA, Tokyo (JP)

(72) Inventor: Takeshi Tsukahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/093,286

(22) Filed: Nov. 9, 2020

(65) Prior Publication Data

US 2021/0165341 A1 Jun. 3, 2021

(30) Foreign Application Priority Data

Nov. 28, 2019 (JP) ..... JP2019-215828

(51) Int. Cl.
*G03G 15/08* (2006.01)

(52) U.S. Cl.
CPC ..... *G03G 15/0808* (2013.01)

(58) Field of Classification Search
CPC ..... G03G 15/0808; G03G 2215/0193; G03G 15/0136
See application file for complete search history.

(56) References Cited

U.S. PATENT DOCUMENTS

2019/0286003 A1* 9/2019 Iwadate ..... G03G 15/602

FOREIGN PATENT DOCUMENTS

| | | | |
|---|---|---|---|
| JP | 2012234205 | A | 11/2012 |
| JP | 2014134780 | A | 7/2014 |
| JP | 2016161715 | A | 9/2016 |
| JP | 2017161839 | A | 9/2017 |

* cited by examiner

*Primary Examiner* — Sevan A Aydin
(74) *Attorney, Agent, or Firm* — Canon U.S.A., Inc. I.P. Division

(57) ABSTRACT

An image forming apparatus includes a first photosensitive drum, a first developing unit including a first developing roller configured to contact the first photosensitive drum, a second photosensitive drum, and a second developing unit including a second developing roller configured to contact the second photosensitive drum. The image forming apparatus includes a first movement mechanism configured to move the first developing unit so that the first developing unit is located at a first contact position and a first separation position, and a second movement mechanism configured to move the second developing unit so that the second developing unit is located at a second contact position, a second separation position, and an intermediate position between the second contact position and the second separation position.

19 Claims, 11 Drawing Sheets

IMAGE FORMING APPARATUS

BACKGROUND

Field of the Disclosure

The present disclosure generally relates to an image forming apparatus using an electrophotographic method.

Description of the Related Art

Examples of an image forming apparatus include an electrophotographic copying machine, an electrophotographic printer (e.g., light-emitting diode (LED) printer and laser beam printer), a facsimile machine, and a word processor.

An image forming apparatus using a contact development method for performing development in a state where a developing roller as a developer bearing member is in contact with a photosensitive drum as a photosensitive member is known. In a case where the contact development method is used, the developing roller and the photosensitive drum are separated from each other except when an image is formed, whereby it is possible to reduce the wearing away of the photosensitive drum and the deterioration of the developing roller.

Japanese Patent Application Laid-Open No. 2012-234205 discusses an image forming apparatus capable of forming a full-color image using first to fourth cartridges. Further, the image forming apparatus discussed in Japanese Patent Application Laid-Open No. 2012-234205 can form a monocolor image in a state where a photosensitive drum and a developing roller contact each other in one of the cartridges, and a photosensitive drum is separate from a developing roller in each of the other cartridges. In other words, the image forming apparatus discussed in Japanese Patent Application Laid-Open No. 2012-234205 can perform an image forming operation using one or some of the cartridges (image forming units).

SUMMARY

The present disclosure is further developed from the conventional technique. The present disclosure is directed to providing an image forming apparatus capable of executing an image forming operation using one or more of the image forming units, and shortening the time during which the state where a developing roller and a photosensitive drum contact each other is maintained.

According to an aspect of the present disclosure, an image forming apparatus includes a first image forming unit having a first drum unit including a first photosensitive drum, and a first developing unit including a first developing roller configured to contact the first photosensitive drum, a second image forming unit having a second drum unit including a second photosensitive drum, and a second developing unit including a second developing roller configured to contact the second photosensitive drum, a first movement mechanism configured to move the first developing unit so that the first developing unit is located at a first contact position where the first developing roller contacts the first photosensitive drum, and a first separation position where the first developing roller is separate from the first photosensitive drum, a second movement mechanism configured to move the second developing unit so that the second developing unit is located at a second contact position where the second developing roller contacts the second photosensitive drum, a second separation position where the second developing roller is separate from the second photosensitive drum, and an intermediate position between the second contact position and the second separation position, and a control unit configured to execute a first image forming operation in a state where the first developing roller contacts the first photosensitive drum, and the second developing roller is separate from the second photosensitive drum, wherein the first movement mechanism is configured to start moving the first developing unit from the first contact position to the first separation position in a state where the second developing unit is located between the second contact position and the second separation position.

Further features of the present disclosure will become apparent from the following description of exemplary embodiments with reference to the attached drawings.

DESCRIPTION OF THE EMBODIMENTS

With reference to the drawings, example configurations according to the present disclosure will be described. In principle, dimensions, materials, shapes, and arrangements of components described in exemplary embodiments should be appropriately changed according to the configuration of an apparatus to which the present disclosure is applied, and various conditions.

<Overall Configuration of Image Forming Apparatus>

Figure 1:
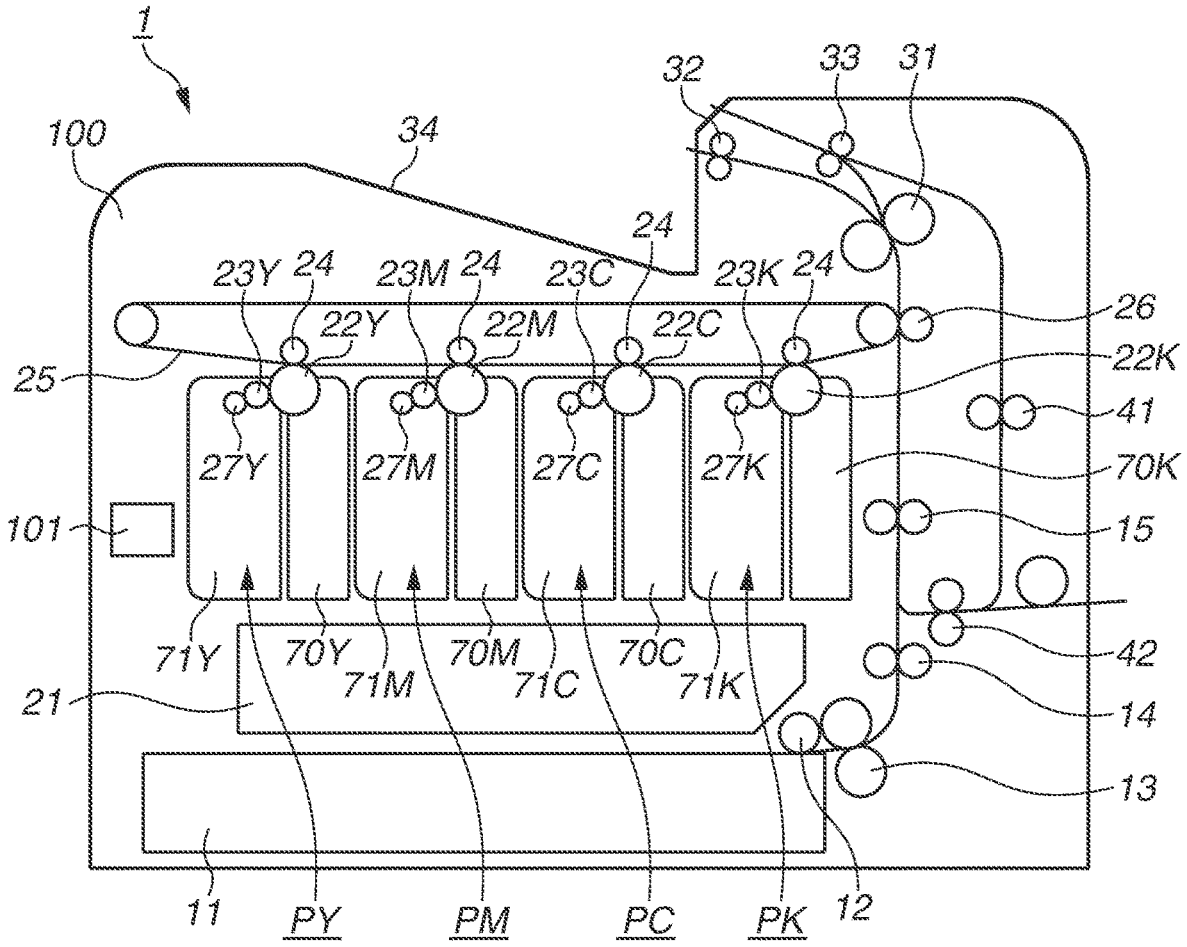
FIG. 1 is a cross-sectional view schematically illustrating a configuration of an image forming apparatus.

A first exemplary embodiment is described. With reference to FIG. 1, an overall configuration of an image forming apparatus 1 is described.

FIG. 1 is a cross-sectional view schematically illustrating the configuration of the image forming apparatus 1.

The image forming apparatus 1 can form a full-color image and a mono-color image. The image forming apparatus 1 is a laser beam printer using a scanner 21 as an exposure apparatus. The present disclosure can also be applied to an exposure apparatus other than the scanner 21, such as a so-called light-emitting diode (LED) printer using a light-emitting diode.

The image forming apparatus 1 includes an apparatus main body 100. In a lower portion of the apparatus main body 100, a cassette 11 that stores a recording material such as paper is arranged. The cassette 11 is configured to be inserted into and removed from the apparatus main body 100. The recording material stored in the cassette 11 is taken out of the cassette 11 by a pickup roller 12 and a sheet feeding roller 13. The recording material taken out of the cassette 11 is conveyed by conveyance roller pairs 14 and 15 to a secondary transfer roller 26 that forms a secondary transfer unit. The conveyance roller pair 15 has a function of registration rollers that adjust the conveying direction of the recording material.

The apparatus main body 100 includes four process cartridges P as image forming units. More specifically, process cartridges PY, PM, PC, and PK are attached to the apparatus main body 100. Each process cartridge P (PY, PM, PC, PK) is configured to be attached to and detached from the apparatus main body 100. The process cartridge PY is adjacent to the process cartridge PM. The process cartridge PM is adjacent to the process cartridge PC. The process cartridge PC is adjacent to the process cartridge PK.

Each process cartridge P (PY, PM, PC, PK) includes a photosensitive drum 22 (22Y, 22M, 22C, 22K) equivalent to an image bearing member or a photosensitive member, and a developing roller 23 (23Y, 23M, 23C, 23K) equivalent to a developer bearing member. The process cartridge P (PY, PM, PC, PK) includes a supply roller 27 (27Y, 27M, 27C, 27K) that comes into contact with the developing roller 23 (23Y, 23M, 23C, 23K) and supplies toner. The process cartridge P (PY, PM, PC, PK) includes a charging member (not illustrated) that charges the photosensitive drum 22 (22Y, 22M, 22C, 22K).

The process cartridge PY is an image forming unit (fourth image forming unit) that forms a yellow image. The process cartridge PY includes a photosensitive unit (fourth photosensitive unit, fourth drum unit) 70Y including the photosensitive drum (fourth photosensitive drum) 22Y. The process cartridge PY includes a developing unit (fourth developing unit) 71Y including the developing roller (fourth developing roller) 23Y that can contact the photosensitive drum 22Y, and the supply roller 27Y. To develop an electrostatic latent image on the photosensitive drum 22Y, the developing unit 71Y stores yellow toner. The developing unit 71Y is configured to be movable relative to the photosensitive unit 70Y between a contact position where the developing roller 23Y contacts the photosensitive drum 22Y, and a separation position where the developing roller 23Y separates from the photosensitive drum 22Y.

The process cartridge PM is an image forming unit (third image forming unit) that forms a magenta image. The process cartridge PM includes a photosensitive unit (third photosensitive unit, third drum unit) 70M including the photosensitive drum (third photosensitive drum) 22M. The process cartridge PM includes a developing unit (third developing unit) 71M including the developing roller (third developing roller) 23M that can contact the photosensitive drum 22M, and the supply roller 27M. To develop an electrostatic latent image on the photosensitive drum 22M, the developing unit 71M stores magenta toner. The developing unit 71M is configured to be movable relative to the photosensitive unit 70M between a contact position where the developing roller 23M contacts the photosensitive drum 22M, and a separation position where the developing roller 23M separates from the photosensitive drum 22M.

The process cartridge PC is an image forming unit (second image forming unit) that forms a cyan image. The process cartridge PC includes a photosensitive unit (second photosensitive unit, second drum unit) 70C including the photosensitive drum (second photosensitive drum) 22C. The process cartridge PC includes a developing unit (second developing unit) 71C including the developing roller (second developing roller) 23C that can contact the photosensitive drum 22C, and the supply roller 27C. To develop an electrostatic latent image on the photosensitive drum 22C, the developing unit 71C stores cyan toner. The developing unit 71C is configured to be movable relative to the photosensitive unit 70C between a contact position where the developing roller 23C contacts the photosensitive drum 22C, and a separation position where the developing roller 23C separates from the photosensitive drum 22C.

The process cartridge PK is an image forming unit (first image forming unit) that forms a black image. The process cartridge PK includes a photosensitive unit (first photosensitive unit, first drum unit) 70K including the photosensitive drum (first photosensitive drum) 22K. The process cartridge PK includes a developing unit (first developing unit) 71K including the developing roller (first developing roller) 23K that can contact the photosensitive drum 22K, and the supply roller 27K. To develop an electrostatic latent image on the photosensitive drum 22K, the developing unit 71K stores black toner. The developing unit 71K is configured to be movable relative to the photosensitive unit 70K between a contact position where the developing roller 23K contacts the photosensitive drum 22K, and a separation position where the developing roller 23K separates from the photosensitive drum 22K.

The names "first image forming unit", "second image forming unit", "third image forming unit", and "fourth image forming unit" are designated for convenience to distinguish members.

The signs "Y", "M", "C", and "K" mean the colors (yellow, magenta, cyan, and black) of images to be formed by the respective process cartridges P (PY, PM, PC, PK). In the present exemplary embodiment, the configurations of the respective process cartridges P (PY, PM, PC, PK) are the same as each other except for the colors of the stored toner. In the following description, unless it is particularly necessary to distinguish colors, the above signs will sometimes be omitted.

The apparatus main body 100 includes the scanner 21 as an exposure apparatus that exposes the photosensitive drum 22 (22Y, 22M, 22C, 22K) with light. When an image forming operation is performed, the scanner 21 emits laser light to the photosensitive drum 22 (22Y, 22M, 22C, 22K) charged by the charging member. With this operation, an electrostatic latent image is formed on the photosensitive drum 22 (22Y, 22M, 22C, 22K).

As described above, each process cartridge P (PY, PM, PC, PK) stores toner corresponding to the color of an image to be formed. In the present exemplary embodiment, non-magnetic monocomponent toner is used. The toner is supplied to the developing roller 23 (23Y, 23M, 23C, 23K) by the supply roller 27 (27Y, 27M, 27C, 27K). The developing roller 23 (23Y, 23M, 23C, 23K) contacts the photosensitive drum 22 (22Y, 22M, 22C, 22K). A developing bias (developing voltage) is applied to the developing roller 23 (23Y, 23M, 23C, 23K), the electrostatic latent image is developed with toner, and a toner image is formed on the photosensitive drum 22 (22Y, 22M, 22C, 22K).

The apparatus main body 100 includes an intermediate transfer belt 25 as an intermediate transfer member. Within the intermediate transfer belt 25, a primary transfer roller 24 corresponding to each photosensitive drum 22 (22Y,22M, 22C, 22K) is arranged.

A transfer voltage is applied to the primary transfer roller 24, whereby the toner image formed on the photosensitive drum 22 (22Y, 22M, 22C, 22K) is transferred onto the intermediate transfer belt 25. Then, a toner image made of overlapped four colors is conveyed to the secondary transfer unit. Then, the toner image is transferred from the intermediate transfer belt 25 onto the recording material by the secondary transfer roller 26.

The recording material onto which the toner image is transferred is conveyed to a fixing roller 31 in a fixing device while holding the toner images. Then, heat and pressure are applied to the recording material. In this way, the toner image is fixed to the recording material. The recording material subjected to the fixing process is discharged to a sheet discharge tray 34 through a sheet discharge roller 32.

In a case where two-sided printing is performed on the recording material, the recording material subjected to the fixing process is conveyed to a reverse roller 33. Further, the recording material is switched back by the reverse roller 33 and conveyed to conveyance roller pairs 41 and 42. Then, the recording material is conveyed to the conveyance roller pair 15 again by the conveyance roller pairs 41 and 42. An image is formed on the back surface of the recording material by a procedure similar to that on the front surface of the recording material, and the recording material is discharged to the sheet discharge tray 34.

The apparatus main body 100 includes a control unit 101 that controls the image forming operation on the recording material as described above, and a main driving unit 50.

<Driving Configuration of Development Movement Mechanism>

The apparatus main body 100 includes a development movement mechanism (movement mechanism or development contact/separation mechanism) for moving the developing unit 71 relative to the photosensitive unit 70. The development movement mechanism moves the developing unit 71 (71Y, 71M, 71C, 71K) so that the photosensitive drum 22 and the developing roller 23 enter a contact state when an image is formed, and the photosensitive drum 22 and the developing roller 23 enter a separation state except when an image is formed.

The apparatus main body 100 includes a main driving unit 50. With reference to FIGS. 2, 3A, 3B, and 3C, the configuration of the main driving unit 50 is described.

Figure 2:
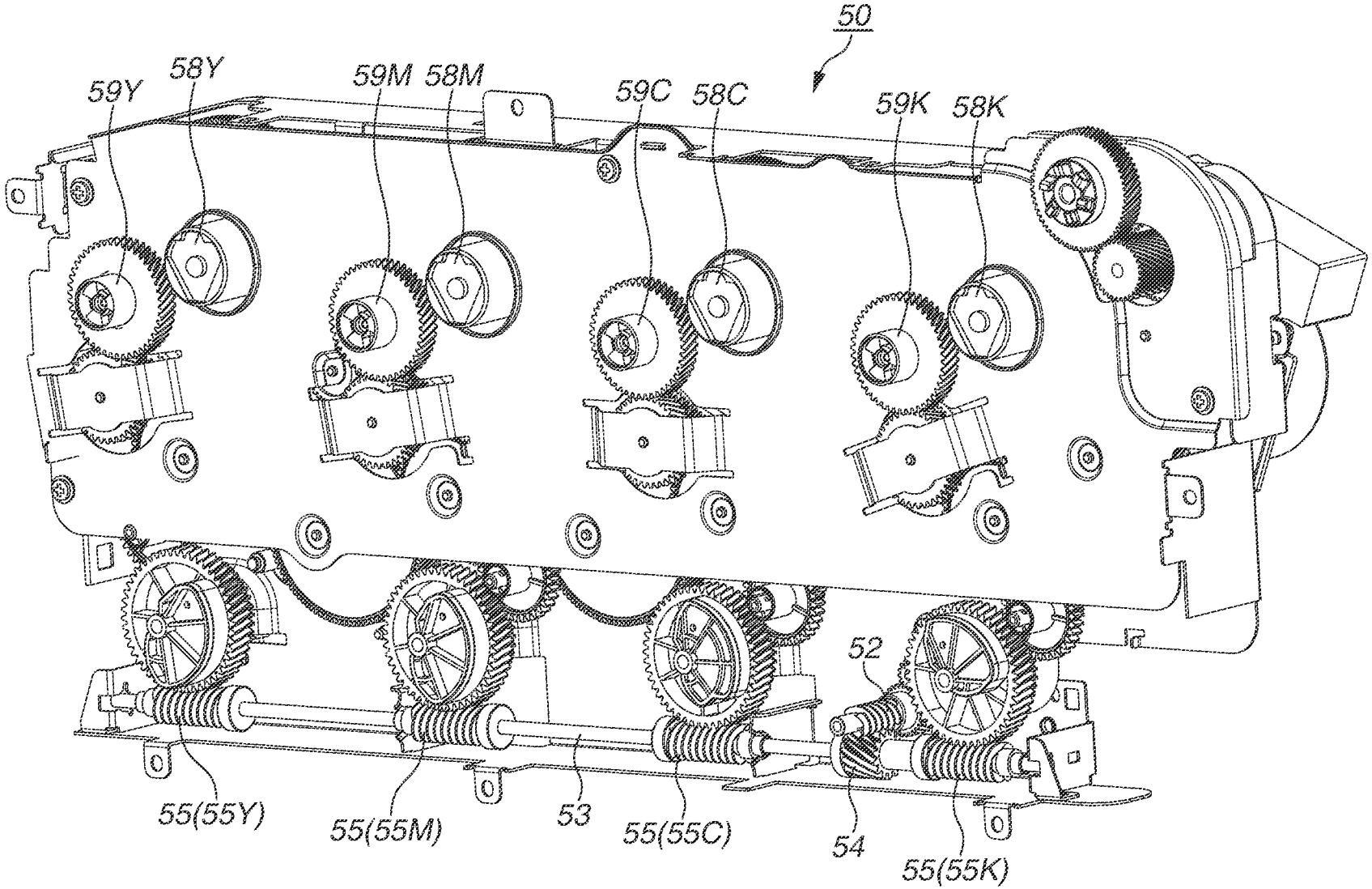
FIG. 2 is a perspective view of a main driving unit.

FIG. 2 is a perspective view of the main driving unit 50 according to the present exemplary embodiment.

Figure 3A:
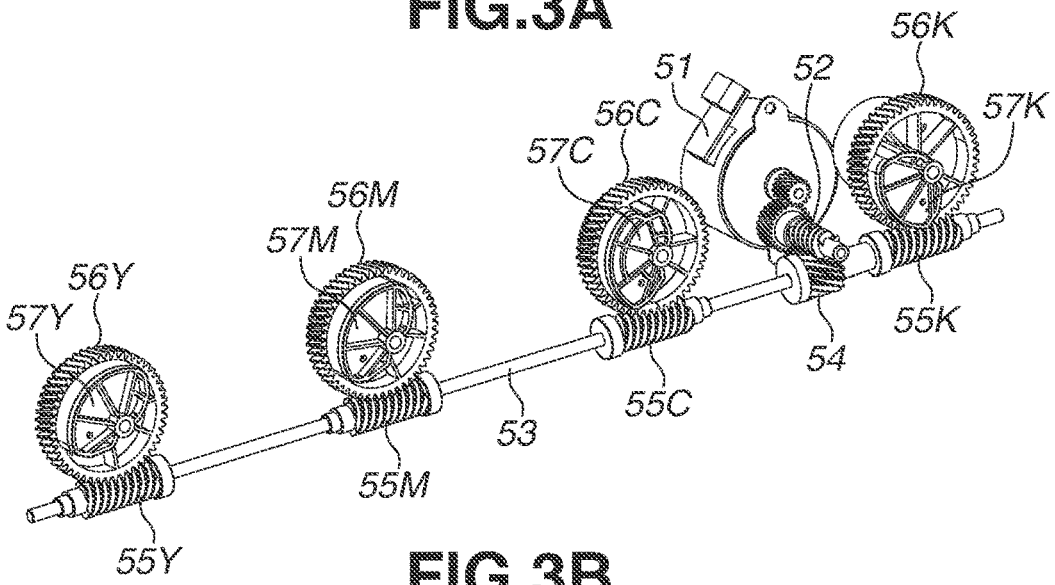
FIGS. 3A, 3B, and 3C are perspective views respectively illustrating the main driving unit in a separation mode, the main driving unit in a color mode, and the main driving unit in a mono mode.
Figure 3B:
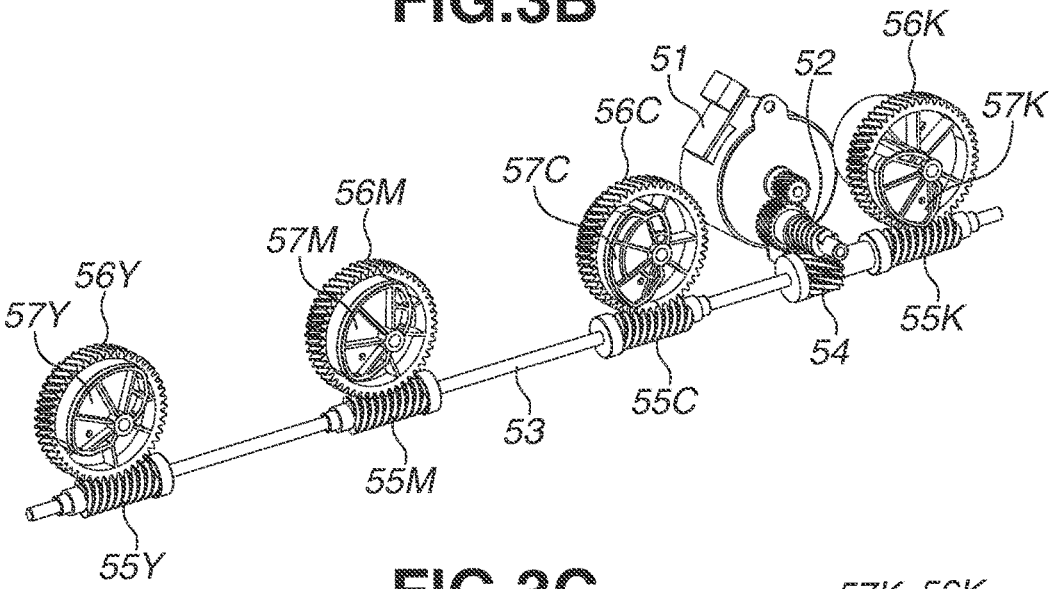
Figure 3C:
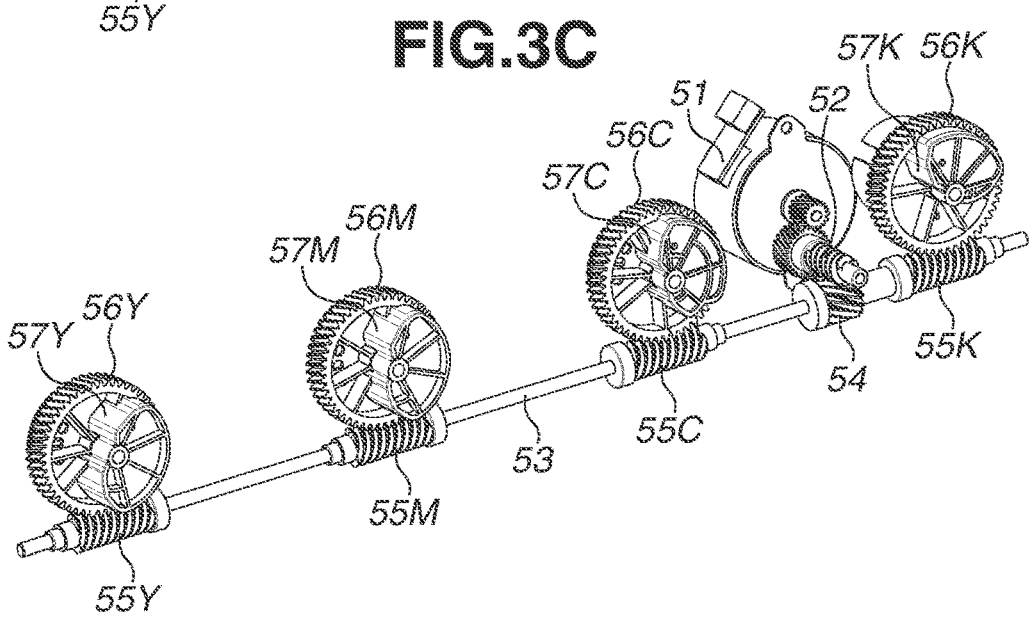

FIGS. 3A to 3C are perspective views illustrating the inside of the main driving unit 50 according to the present exemplary embodiment. FIG. 3A is a perspective view illustrating the main driving unit 50 in a separation mode. FIG. 3B is a perspective view illustrating the main driving unit 50 in a color mode. FIG. 3C is a perspective view illustrating the main driving unit 50 in a mono mode (monochrome mode).

The main driving unit 50 illustrated in FIG. 2 includes drum driving units 58Y, 58M, 58C, and 58K that drive the photosensitive drums 22Y, 22M, 22C, and 22K, respectively. The main driving unit 50 includes development driving units 59Y, 59M, 59C, and 59K that drive the developing rollers 23Y, 23M, 23C, and 23K, respectively. Further, the main driving unit 50 includes a gear train that drives the development movement mechanism for moving the developing unit 71.

As illustrated in FIGS. 3A to 3C, the main driving unit 50 includes a contact/separation motor 51 serving as a driving source. A pinion gear is attached to an output shaft of the contact/separation motor 51 and meshes with a stepped gear 52.

As illustrated in FIGS. 2, 3A, 3B, and 3C, the main driving unit 50 includes a worm shaft 53 extending in a direction intersecting (in the present exemplary embodiment, orthogonal to) the rotational axis direction of the stepped gear 52. In other words, the rotational axis direction of the worm shaft 53 intersects the rotational axis direction of the stepped gear 52. The rotational axis direction of the worm shaft 53 intersects the rotational axis directions of the drum driving units 58Y, 58M, 58C, and 58K and the development driving units 59Y, 59M, 59C, and 59K.

The worm shaft 53 is provided with a worm wheel gear 54 and a worm gear 55 (55Y, 55M, 55C, 55K). The main driving unit 50 includes a cam gear 56 (56Y, 56M, 56C, 56K) and a cam portion 57 (57Y, 57M, 57C, 57K) that correspond to each process cartridge P.

The worm wheel gear 54 meshes with the stepped gear 52. The worm gear 55 (55Y, 55M, 55C, 55K) meshes with the cam gear 56 (56Y, 56M, 56C, 56K). The cam gear 56 (56Y, 56M, 56C, 56K) and the cam portion 57 (57Y, 57M, 57C, 57K) are configured to integrally rotate.

The worm wheel gear 54 and the worm gear 55 (55Y, 55M, 55C, 55K) are fixed to the worm shaft 53 with metal pins (not illustrated) and restricted from rotating relative to the worm shaft 53. Thus, if the contact/separation motor 51 rotates, the worm wheel gear 54 and the worm shaft 53 rotate by the stepped gear 52, and the worm gear 55 (55Y, 55M, 55C, 55K) rotates. If the worm gear 55 (55Y, 55M, 55C, 55K) rotates, the cam gear 56 (56Y, 56M, 56C, 56K) and the cam portion 57 (57Y, 57M, 57C, 57K) rotate.

The contact/separation motor 51, the stepped gear 52, the worm shaft 53, the worm wheel gear 54, the worm gear 55 (55Y to 55K), the cam gear 56 (56Y to 56K), and the cam portion 57 (57Y to 57K) can be said to be a part of the development movement mechanism for moving the developing unit 71. A movement unit 90 can also be said to be a part of the development movement mechanism.

The cam gear 56 (56Y to 56K) and the cam portion 57 (57Y to 57K) are configured to integrally rotate by the worm shaft 53 and the worm gear 55 (55Y to 55K). In other words, in the main driving unit 50 according to the present exemplary embodiment, the cam portions 57 (57Y, 57M, 57C, 57K) corresponding to the respective process cartridges P are configured to be integrally driven by driving a single contact/separation motor 51.

The phases of the cam portions 57 (57Y, 57M, 57C, 57K) corresponding to the respective process cartridges P are shifted from each other. With this configuration, if the contact/separation motor 51 rotates in one direction, the process cartridges P are configured to perform a contact operation and a separation operation in a sequential order.

The control unit 101 controls the main driving unit 50. More specifically, the control unit 101 can control the contact/separation motor 51 to change the position (rotational phase) of the cam portion 57 (57Y, 57M, 57C, 57K) to a separation mode (FIG. 3A), a color mode (FIG. 3B), and a mono mode (FIG. 3C).

The state where the position of the cam portion 57 (57Y, 57M, 57C, 57K) is in the separation mode can also be referred to as "the separation mode of the image forming apparatus 1 or the main driving unit 50". The state where the position of the cam portion 57 (57Y, 57M, 57C, 57K) is in the color mode can also be referred to as "the color mode of the image forming apparatus 1 or the main driving unit 50". The state where the position of the cam portion 57 (57Y, 57M, 57C, 57K) is in the mono mode can also be referred to as "the mono mode of the image forming apparatus 1 or the main driving unit 50".

The control unit 101 is configured to execute an image forming operation (first image forming operation) in the state where the main driving unit 50 of the image forming apparatus 1 is in the mono mode. The control unit 101 is configured to execute an image forming operation (second image forming operation) in the state where the main driving unit 50 of the image forming apparatus 1 is in the color mode.

<Details of Development Movement Mechanism>

Next, with reference to FIGS. 4A to 4E, the details of a movement unit 90 as a part of the development movement mechanism are described.

Figure 4A:
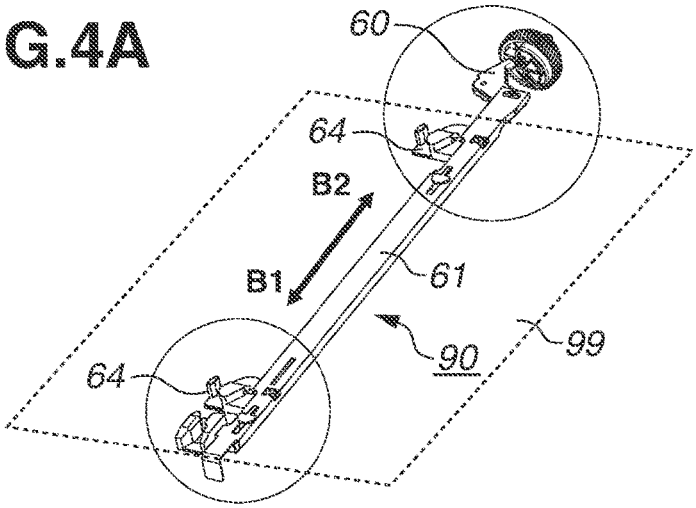
FIG. 4A is an overall perspective view of a movement unit.
Figure 4B:
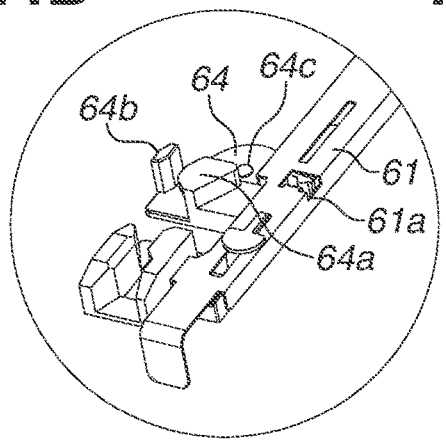
FIGS. 4B, 4C, 4D and 4E are partial enlarged views respectively illustrating one end side of the movement unit (front side of apparatus main body), the other end side of the movement unit (back side of apparatus main body), the one end side of the movement unit in a state where a slider is omitted, and the other end side of the movement unit (back side of apparatus main body) in the state where the slider is omitted.
Figure 4C:
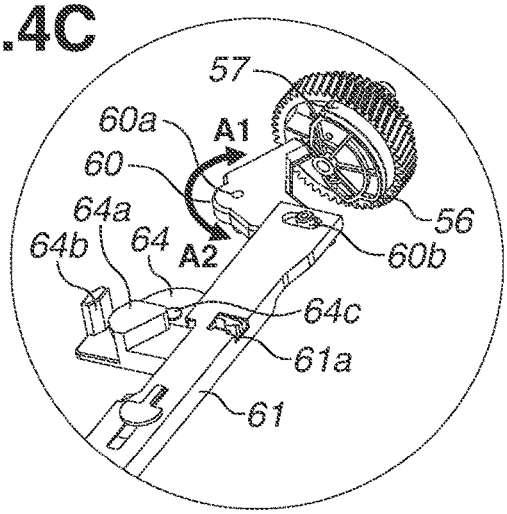
Figure 4D:
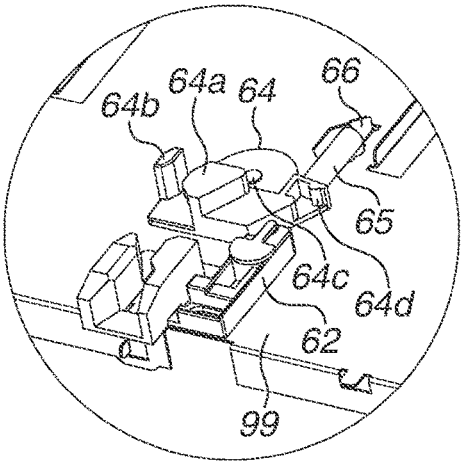
Figure 4E:
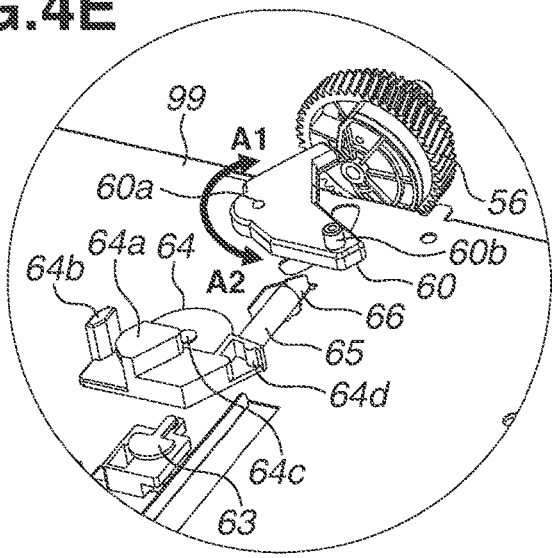

FIGS. 4A to 4E are perspective views of the movement unit 90. FIG. 4A is an overall perspective view of the movement unit 90. FIG. 4B is a partial enlarged view of one end side of the movement unit 90 (front side of the apparatus main body 100). FIG. 4C is a partial enlarged view of the other end side of the movement unit 90 (back side of the apparatus main body 100). FIG. 4D is a partial enlarged view of the one end side of the movement unit 90 in a state where a slider 61 is omitted. FIG. 4E is a partial enlarged view of the other end side of the movement unit 90 (back side of the apparatus main body 100) in a state where the slider 61 is omitted.

As illustrated in FIGS. 4A to 4E, the movement unit 90 includes a lever 60 that comes into contact with the cam portion 57, a slider 61 connected to the lever 60, movement members 64 connected to the slider 61, and biasing members 65. The lever 60 has a function of a cam follower that comes into contact with the cam portion 57. One of the movement members 64 is configured to come into contact with the developing unit 71 and has a function of a pressing member (movement member) that moves the developing unit 71 by pressing the developing unit 71. The slider 61 and the lever 60 have a function of a coupling portion (intermediate portion) that couples the movement member 64 and the cam portion 57. The apparatus main body 100 includes four movement units 90 to correspond to the respective process cartridges P (PY, PM, PC, PK). The configurations of the movement units 90 are the same.

The lever 60 is supported by a frame 99 of the apparatus main body 100 so that the lever 60 can rotate about a lever center 60*a*. More specifically, the lever 60 includes a columnar portion at a position corresponding to the lever center 60*a*, and the columnar portion is inserted into a hole provided in the frame 99. In this way, the lever 60 is held pivotably about the lever center 60*a* (FIGS. 4C and 4E). As illustrated in FIG. 4C, the lever 60 includes a boss portion 60*b* and is fitted to a long round hole of the slider 61.

If the cam portion 57 rotates so as to increase the cam radius at a portion where the cam portion 57 and the lever 60 opposes each other, the cam portion 57 comes into contact with the lever 60. Then, the lever 60 rotates (swings) about the lever center 60*a* in the direction of an arrow A2 (separation direction).

In an opposite manner, if the cam portion 57 rotates so as to decrease the cam radius at the portion where the cam portion 57 and the lever 60 oppose each other, the lever 60 swings in the direction of an arrow A1 (contact direction). If the cam portion 57 continues to rotate, the cam portion 57 separates from the lever 60.

On the other hand, the slider 61 is held by slider guides 62 and 63 fixed to the frame 99 so that the slider 61 can linearly move in the front surface direction (B1 direction) and the back surface direction (B2 direction) of the apparatus main body 100 (FIGS. 4D and 4E). In the present exemplary embodiment, the front surface direction (B1 direction) and the back surface direction (B2 direction) of the apparatus main body 100 are parallel to the direction of the rotational axis of the photosensitive drum 22, the direction of the rotational axis of the developing roller 23, the direction of the pinion gear of the contact/separation motor 51, and the direction of the rotational axis of the stepped gear 52. The direction in which the process cartridge P is attached to the apparatus main body 100 is the same direction as the B2 direction. The direction in which the process cartridge P is taken out of the apparatus main body 100 is the same direction as the B1 direction.

If the lever 60 rotates in the A1 direction, the slider 61 moves in the B1 direction (contact direction). If the lever 60 rotates in the A2 direction, the slider 61 moves in the B2 direction (separation direction).

The movement members 64 and the biasing members (compression springs) 65 are provided at two locations in the moving direction of the slider 61 (FIGS. 4D and 4E). Each movement member 64 is supported by the frame 99 of the apparatus main body 100 so that the movement member 64 can rotate about a rotation center 64*c*. More specifically, the movement member 64 includes a columnar portion at a position corresponding to the rotation center 64*c*, and the columnar portion is inserted into a hole provided in the frame 99. In this way, the movement member 64 is held pivotably about the rotation center 64*c*.

On the other hand, a spring reception portion 66 is provided in the frame 99. Then, the biasing member 65 is attached between the movement member 64 and the spring reception portion 66.

A bending portion 61*a* is provided in the slider 61 and can come into contact with a rib 64*d* of the movement member 64. If the slider 61 moves by a certain amount or more in the B2 direction (separation direction), the bending portion 61*a* and the rib 64*d* come into contact with each other, the movement member 64 pivots, and the biasing member 65 is compressed. In an opposite manner, if the slider 61 moves by a certain amount or more in the B1 direction (contact direction), the bending portion 61*a* and the rib 64*d* separate from each other.

<Relationship Between Development Movement Mechanism and Process Cartridge>

Figure 5A:
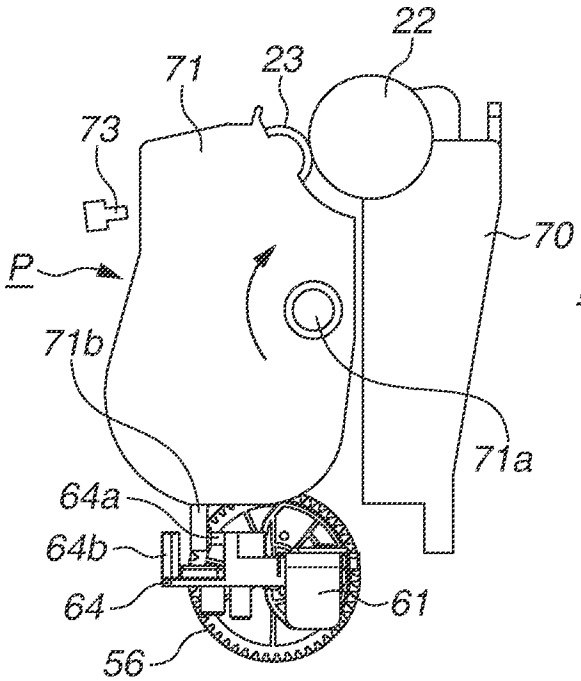
FIGS. 5A, 5B, 5C are side views respectively illustrating a process cartridge in a state where a developing unit is in an contact state, the process cartridge in a state where the developing unit is in a separation state, and the process cartridge in a state where the developing unit is in an intermediate state (small separation state).
Figure 5B:
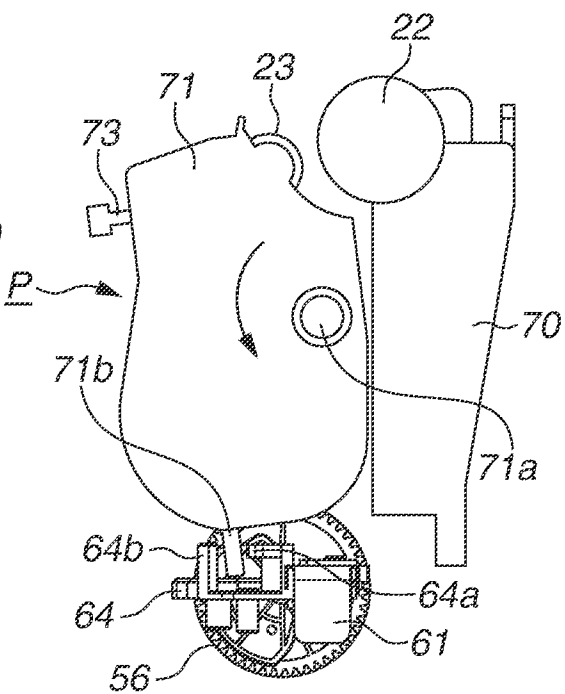
Figure 5C:
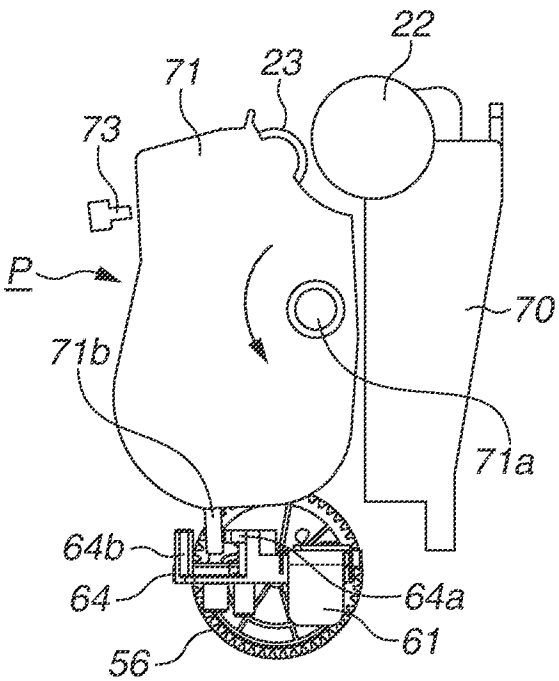

Next, with reference to FIGS. 5A, 5B, and 5C, a relationship between the development movement mechanism and each process cartridge P is described.

FIGS. 5A to 5C are side views of each process cartridge P according to the present exemplary embodiment. FIG. 5A is a side view of the process cartridge P in a case where the developing unit 71 is in a contact state. FIG. 5B is a side view of the process cartridge P in a case where the developing unit 71 is in a separation state. FIG. 5C is a side view of the process cartridge P in a case where the developing unit 71 is in an intermediate state (small separation state). FIGS. 5A, 5B, and 5C are views of the process cartridge P viewed along the rotational axis of the developing roller 23. In the present exemplary embodiment, the rotational axis of the developing roller 23 is parallel to the rotational axis of the photosensitive drum 22 and the rotational axis of the developing unit 71.

The developing unit 71 is configured to pivot about a pin 71*a* as a swinging center while rotatably supporting the developing roller 23. In the present exemplary embodiment, the developing unit 71 is joined to the photosensitive unit 70 so that the developing unit 71 can rotate about the pin 71*a*. The present disclosure, however, can also be applied to a configuration in which the developing unit 71 and the photosensitive unit 70 are independently supported by the apparatus main body 100.

The developing unit 71 includes a pressing target portion 71*b* to be pressed by a pressing portion 64*a* of the movement member 64. The pressing target portion 71*b* has a function of a force reception portion that receives a force from the pressing portion 64*a* of the movement member 64.

To contact the developing roller 23 to the photosensitive drum 22, the lever 60 rotates in the A1 direction, and the slider 61 moves in the B direction. Then, the movement member 64 rotates about the rotation center 64*c*, and the pressing portion 64*a* comes into contact with the pressing target portion 71*b*. Then, the developing unit 71 rotates in the clockwise direction in FIG. 5A and biases the developing roller 23 toward the photosensitive drum 22 (FIG. 5A). In the present exemplary embodiment, the biasing member 65 biases the movement member 64 toward the developing unit 71. In other words, the movement member 64 biases the developing unit 71 by the biasing force of the biasing member 65. The position of the developing unit 71 when the developing roller 23 contacts the photosensitive drum 22 is referred to as a "contact position". The state where the developing unit 71 is located at the contact position is referred to as a "contact state of the developing unit 71".

When the developing roller 23 is separated from the photosensitive drum 22, the lever 60 rotates in the A2 direction, and the slider 61 moves in the B2 direction. Then, the movement member 64 rotates about the rotation center 64*c*, and the pressing portion 64*a* retracts in the right direction in FIG. 5B. If the pressing portion 64*a* retracts, the developing unit 71 rotates under its own weight in the counterclockwise direction, and the photosensitive drum 22 and the developing roller 23 separate from each other.

On the other hand, the apparatus main body 100 includes a weight sensor 73 that comes into contact with the developing unit 71 and measures the weight of the developing unit 71. The weight of the developing unit 71 is detected, whereby the amount of toner stored in the developing unit 71 is detected.

In the present exemplary embodiment, to prevent influence on the measurement of the weight sensor 73, when the developing unit 71 comes into contact with the weight sensor 73, the pressing portion 64*a* of the movement member 64 is located at a position separate from the pressing target portion 71*b* (separation state of the developing unit 71).

The movement member 64 can also bring the developing unit 71 into a small separation state (FIG. 5C) so that the developing roller 23 separates from the photosensitive drum 22, and the developing unit 71 separates from the weight sensor 73.

On the other hand, the movement member 64 includes a separation guarantee portion 64*b* arranged with a space from the pressing target portion 71*b*. The separation guarantee portion 64*b* is configured to come into contact with the pressing target portion 71*b* when shock is given to the apparatus main body 100 due to a fall while the image forming apparatus 1 is carried in a state where the process cartridge P is attached to the apparatus main body 100. This prevents the developing roller 23 from colliding with the photosensitive drum 22.

The space between the photosensitive drum 22 and the developing roller 23 when the developing unit 71 is located at a small separation position is smaller than the space between the photosensitive drum 22 and the developing roller 23 when the developing unit 71 is located at the separation position. In other words, the distance between the photosensitive drum 22 and the developing roller 23 when the developing unit 71 is located at the small separation position is shorter than the distance between the photosensitive drum 22 and the developing roller 23 when the developing unit 71 is located at the separation position. When the developing unit 71 is located at the small separation position, the position of the developing unit 71 is determined by the pressing target portion 71*b* coming into contact with the pressing portion 64*a*, and the developing unit 71 is not in contact with the weight sensor 73.

When the cam portion 57 is in a contact phase (a phase where the developing unit 71 is located at the contact position), the movement member 64 presses the developing unit 71 by the elastic force of the biasing member 65, and the photosensitive drum 22 and the developing roller 23 are located in the contact state.

In the present exemplary embodiment, when the cam portion 57 is in a separation phase (a phase where the developing unit 71 is located at the separation position) or a small separation phase (a phase where the developing unit 71 is located at the small separation position), the cam portion 57 presses the movement member 64 via the lever 60 and the slider 61. At this time, the cam portion 57 locates the movement member 64 at a separation position of the movement member 64 or a small separation position of the movement member 64 against the elastic force of the biasing member 65. The developing unit 71 moves under its own weight in the direction in which the developing roller 23 separates from the photosensitive drum 22. Then, the developing unit 71 is located at the separation position or the small separation position.

<Relationship Between the Shape of the Cam Portion and the Lever>

In the present exemplary embodiment, the cam portions 57Y, 57M, and 57K corresponding to the process cartridges PY, PM, and PK have a same shape. On the other hand, the cam portion 57C corresponding to the process cartridge C adjacent to the process cartridge PK has a different shape from those of the cam portions 57Y, 57M, and 57K. Based on the cam portion 57C, the relationship between the shape of the cam portion 57 and the lever 60 is described.

Figure 6A:
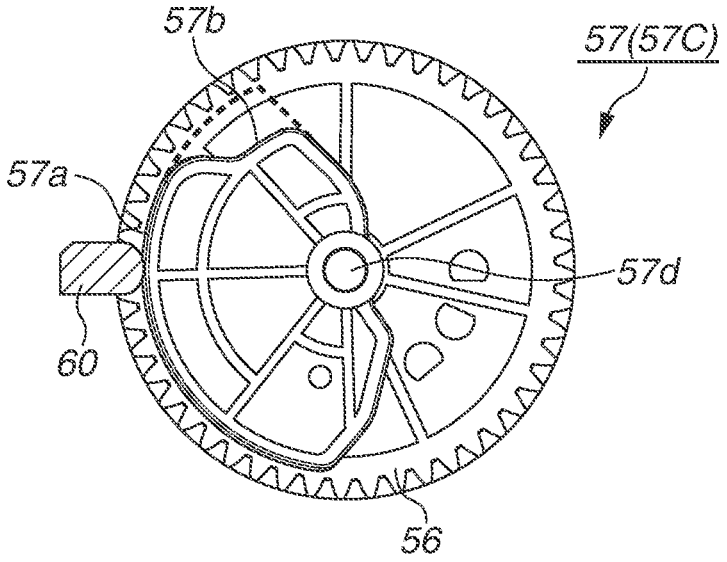
FIGS. 6A, 6B, 6C are diagrams respectively illustrating a relationship between a cam portion and a lever in the separation state, the relationship between the cam portion and the lever in the contact state, and the relationship between the cam portion and the lever in the small separation state.
Figure 6B:
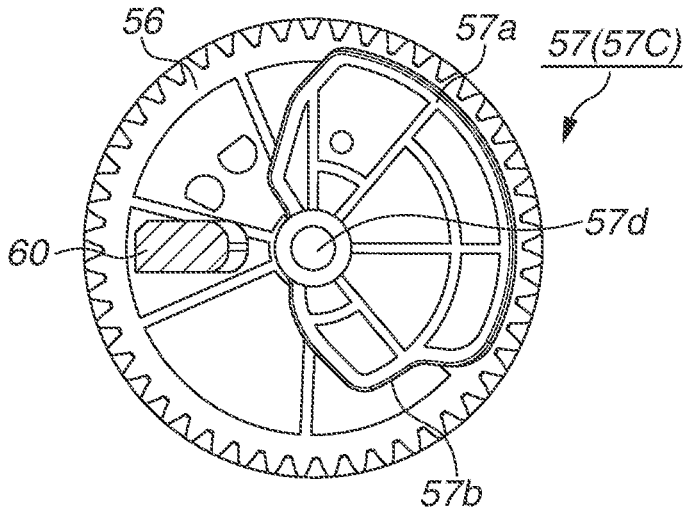
Figure 6C:
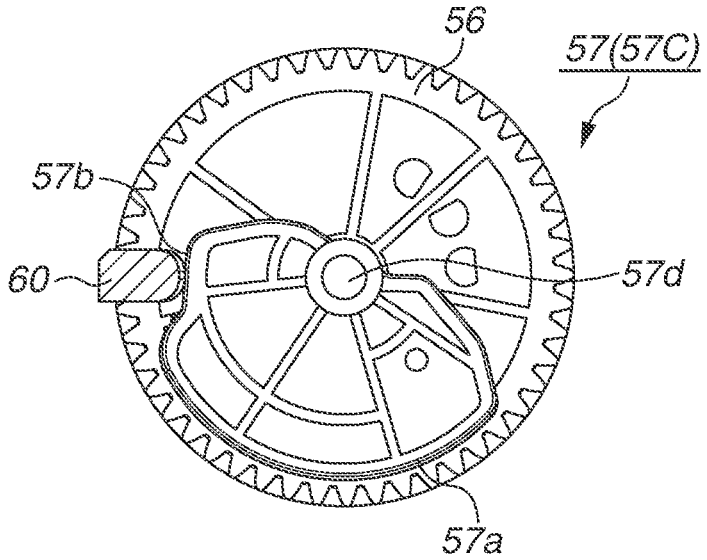

FIGS. 6A to 6C are diagrams each illustrating a relationship between the cam portion 57 (57C) and the lever 60. FIG. 6A is a diagram illustrating a relationship between the cam portion 57 (57C) and the lever 60 in the separation state. FIG. 6B is a diagram illustrating a relationship between the cam portion 57 (57C) and the lever 60 in the contact state.

FIG. 6C is a diagram illustrating a relationship between the cam portion 57 (57C) and the lever 60 in the small separation state.

In the present exemplary embodiment, the cam portion 57C includes a first cam surface (separation surface) 57*a* and a second cam surface (small separation surface) 57*b*. The cam portions 57Y, 57M, and 57K do not include the second cam surface 57*b*, and the first cam surface 57*a* extends as indicated by a dotted line in FIG. 6A. The shapes of the cam portions 57Y, 57M, 57C, and 57K are the same except for the presence or absence of the second cam surface 57*b*. The first cam surface 57*a* is a surface having the greatest distance (radius) from a rotation center 57*d* in a cam surface that comes into contact with the lever 60.

The cam portion 57 and the cam gear 56 are configured to rotate about the rotation center 57*d*. In the present exemplary embodiment, the first cam surface 57*a* has an arc shape having an approximately constant distance (radius) from the rotation center 57*d*. The second cam surface 57*b* has an arc shape having an approximately constant distance (radius) from the rotation center 57*d*. The first cam surface 57*a* and the second cam surface 57*b* are arranged in approximately concentric circles. In other words, the center of the arc shape of the first cam surface 57*a* coincides with the rotation center 57*d* of the cam portion 57. The center of the arc shape of the second cam surface 57*b* coincides with the rotation center 57*d* of the cam portion 57.

The first cam surface 57*a* and the second cam surface 57*b* are not limited to the arc shape, and may have curved surfaces or flat surfaces. In order for the second cam surface 57*b* to stably receive the lever 60, it is desirable that an amount of change in the distance from the rotation center 57*d* with respect to an amount of rotation of the cam portion 57 is smaller in the second cam surface 57*b* than in portions ahead of and behind the second cam surface 57*b* in the rotational direction of the cam portion 57.

When the developing unit 71 is brought into the separation state, the cam portion 57 is located so that the lever 60 comes into contact with the first cam surface (separation surface) 57*a*. At this time, the lever 60 rotates in the A2 direction illustrated in FIG. 4C, and the developing unit 71 enters the separation state (state where the developing unit 71 is located at the separation position).

Next, when the developing unit 71 is brought into the contact state, the cam portion 57 is located so that the lever 60 does not come into contact with the cam portion 57. At this time, the lever 60 rotates in the A1 direction illustrated in FIG. 4C, and the developing unit 71 enters the contact state.

In the present exemplary embodiment, the developing unit 71 (71C) of the process cartridge PC can be located at the small separation position. When the developing unit 71 (71C) is brought into the small separation state (state where the developing unit 71 (71C) is located at the small separation position), the cam portion 57 (57C) is located so that the lever 60 comes into contact with the second cam surface 57*b*. At this time, the lever 60 rotates in the A2 direction, but the amount of rotation of the lever 60 in the A2 direction is smaller than that when the developing unit 71 is brought into the separation state.

To stably form an image on the recording material, it is desirable to contact the photosensitive drum 22 and the developing roller 23 in the entire area in the longitudinal direction (same direction as the rotational axis direction of the photosensitive drum 22 and the rotational axis direction of the developing roller 23). Accordingly, it is necessary to make the biasing force of the biasing member 65 large. Further, it is desirable to arrange the movement members 64 and the biasing members 65 at two locations in the longitudinal direction.

On the other hand, if the biasing force of the biasing member 65 or the numbers of movement members 64 and biasing members 65 increase, and when the developing unit 71 is brought into the separation state or the small separation state, a force applied to the lever 60 and the cam portion 57 becomes large. If the lever 60 is in the state of contacting a sloping surface of the cam portion 57, the cam portion 57 or the cam gear 56 may rotate. Thus, in the present exemplary embodiment, each of the first cam surface 57*a* and the second cam surface 57*b* have an approximately constant distance (radius) from the rotation center 57*d*, and the first cam surface 57*a* and the second cam surface 57*b* are arranged in approximately concentric circles. This can prevent the generation of a force in the rotational direction in the cam gear 56 or the cam portion 57 and maintain the phase of the cam gear 56 or the cam portion 57.

The movement unit 90 that moves the worm gear 55Y, the cam gear 56Y, the cam portion 57Y, and the developing unit 71Y can be said to be a part of the movement mechanism (fourth movement mechanism or fourth position regulation mechanism) for moving the developing unit 71Y. This movement mechanism regulates the position of the developing unit 71Y and enables the developing unit 71Y to move to the contact position and the separation position.

Similarly, the movement unit 90 that moves the worm gear 55M, the cam gear 56M, the cam portion 57M, and the developing unit 71M can be said to be a part of the movement mechanism (third movement mechanism or third position regulation mechanism) for moving the developing unit 71M. This movement mechanism regulates the position of the developing unit 71M and enables the developing unit 71M to move to the contact position and the separation position.

Similarly, the movement unit 90 that moves the worm gear 55C, the cam gear 56C, the cam portion 57C, and the developing unit 71C can be said to be a part of the movement mechanism (second movement mechanism or second position regulation mechanism) for moving the developing unit 71C. This movement mechanism regulates the position of the developing unit 71C and enables the developing unit 71C to move to the contact position, the separation position, and the intermediate position (small separation position).

Similarly, the movement unit 90 that moves the worm gear 55K, the cam gear 56K, the cam portion 57K, and the developing unit 71K can be said to be a part of the movement mechanism (first movement mechanism or first position regulation mechanism) for moving the developing unit 71K. This movement mechanism regulates the position of the developing unit 71K and enables the developing unit 71K to move to the contact position and the separation position.

<Operation of Image Forming Apparatus>

If the state where the photosensitive drum 22 and the developing roller 23 contact each other continues for an extended time, the developing roller 23 can deform. If the photosensitive drum 22 and the developing roller 23 are rotated in a state where the photosensitive drum 22 and the developing roller 23 contact each other, the photosensitive drum 22 and the developing roller 23 rub against each other, and the surface of the developing roller 23 or the photosensitive drum 22 minutely wears away. If the state where the developing roller 23 rotates in a state of contacting the photosensitive drum 22 continues for an extended time, the developing roller 23 or the photosensitive drum 22 can deteriorate. This may result in deteriorating the quality of an image to be formed on the recording material.

To address this problem, in the present exemplary embodiment, when an image forming operation is not performed, the developing roller 23 is separated from the photosensitive drum 22, thereby preventing the deterioration of the developing roller 23 or the photosensitive drum 22.

Figure 7:
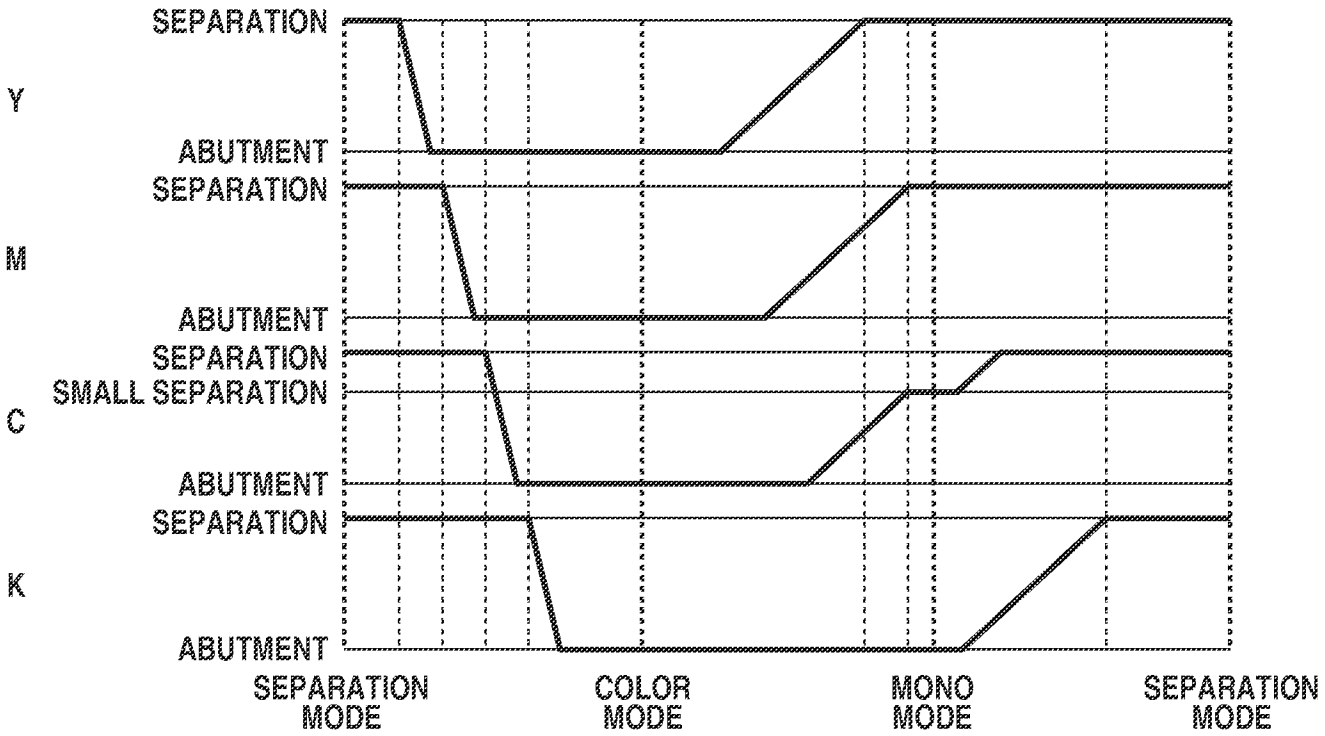
FIG. 7 is a cam diagram illustrating an operation of the image forming apparatus according to a first exemplary embodiment.

Taking such a point into consideration, with reference to FIG. 7, the operation of the image forming apparatus 1 according to the present exemplary embodiment is described. FIG. 7 is a cam diagram illustrating the operation of the image forming apparatus 1 according to the present exemplary embodiment.

The image forming apparatus 1 can execute image forming operations on the recording material in the color mode and the mono mode. The image forming apparatus 1 can also bring all the process cartridges PY, PM, PC, and PK into a state where the developing rollers 23Y, 23M, 23C, and 23K are separate from the photosensitive drums 22Y, 22M, 22C, and 22K, respectively (separation mode).

In the color mode, the image forming operation is performed in a state where the developing rollers 23Y, 23M, 23C, and 23K contact the photosensitive drums 22Y, 22M, 22C, and 22K, respectively.

In the mono mode, the image forming operation is performed in a state where the developing roller 23K contacts the photosensitive drum 22K, and the developing rollers 23Y, 23M, and 23C are separate from the photosensitive drums 22Y, 22M, and 22C, respectively. In other words, the image forming apparatus 1 can perform the image forming operation using a part of the image forming units (process cartridge PK). When the image forming operation is performed in the mono mode, the contact/separation motor 51 is stopped, and the above state is maintained.

The separation mode, the color mode, and the mono mode are switched by the control unit 101 controlling the contact/separation motor 51 of the main driving unit 50 to move the movement member 64. More specifically, the control unit 101 can execute the image forming operation (first image forming operation) in a state where the developing roller 23K contacts the photosensitive drum 22K, and the developing rollers 23Y, 23M, and 23C are separate from the photosensitive drums 22Y, 22M, and 22C, respectively (mono mode). The control unit 101 can execute the image forming operation (second image forming operation) in a state where the developing rollers 23Y, 23M, 23C, and 23K contact the photosensitive drums 22Y, 22M, 22C, and 22K, respectively (color mode).

If the contact/separation motor 51 rotates in a first direction, the main driving unit 50 of the image forming apparatus 1 changes so as to follow the cam diagram in FIG. 7 from left to right. If the contact/separation motor 51 rotates in a second direction that is opposite to the first direction, the main driving unit 50 of the image forming apparatus 1 changes so as to follow the cam diagram in FIG. 7 from right to left.

More specifically, as illustrated in FIG. 7, if the contact/separation motor 51 rotates in the first direction in a state where the image forming apparatus 1 is in the separation mode, the image forming apparatus 1 changes to the color mode. If the contact/separation motor 51 further rotates in the first direction, the image forming apparatus 1 changes to the mono mode. If the contact/separation motor 51 further rotates in the first direction, the image forming apparatus 1 changes to the separation mode. In the state where the image forming apparatus 1 is in the separation mode, the contact/separation motor 51 can rotate in the second direction opposite to the first direction and change the image forming apparatus 1 to the mono mode.

Before the image forming operation is executed, the image forming apparatus 1 waits in the separation state, and each of the developing unit 71Y, 71M, 71C, and 71K is located at the separation position. At this time, the contact/separation motor 51 is stopped, and each of the cam portions 57Y, 57M, 57C, and 57K contacts the corresponding lever 60 on the first cam surface 57*a* (see FIG. 6A).

If the image forming operation is started, the control unit 101 starts driving the contact/separation motor 51. In synchronization with the timing of the image formation of the process cartridges PY, PM, PC, and PK, the developing roller 23 contacts the photosensitive drum 22 in the order of the process cartridges PY, PM, PC, and PK. If the developing roller 23 contacts the photosensitive drum 22 in all of the process cartridges PY, PM, PC, and PK, the image forming apparatus 1 changes to the color mode, and the contact/separation motor 51 is stopped. At this time, each of the cam portions 57Y, 57M, 57C, and 57K is separate from the corresponding lever 60. Then, the image forming apparatus 1 can perform the image forming operation in this state.

The image forming operation of the process cartridges PY, PM, PC, and PK ends in the order of the process cartridges PY, PM, PC, and PK. Thus, the contact/separation motor 51 is driven, and in synchronization with the timing when the image forming operation of the process cartridges PY, PM, PC, and PK ends, the developing roller 23 separates from the photosensitive drum 22 in the order of the process cartridges PY, PM, PC, and PK. The rotational direction of the contact/separation motor 51 is the same as the rotational direction when the image forming apparatus 1 is switched from the separation mode to the color mode. More specifically, after the image forming operation in the color mode ends, the image forming apparatus 1 returns from the color mode through the mono mode to the separation mode.

At this time, after the image forming operation in the color mode is performed, and if the image forming operation is not to be performed in the mono mode, the contact/separation motor 51 does not stop. After the image forming operation in the color mode is performed, and if the image forming operation is to be performed in the mono mode, the contact/separation motor 51 temporarily stops in the mono mode, and the image forming operation is performed. Then, the image forming apparatus 1 returns to the separation mode.

At this time, as illustrated in FIG. 7, in the present exemplary embodiment, the developing unit 71C moves through the small separation position (intermediate position) to the separation position. Then, the movement mechanism for moving the developing unit 71K is configured to start moving the developing unit 71K from the contact position to the separation position in a state where the developing unit 71C is located between the contact position and the separation position.

As illustrated in FIG. 7, in the mono mode according to the present exemplary embodiment, the developing unit 71Y is located at the separation position, and the developing unit 71M is located at the separation position. Then, the developing unit 71C is located at the small separation position (intermediate position) between the contact position and the separation position. At this time, in each of the cam portions 57Y and 57M, the first cam surface 57*a* contacts the lever 60. In the cam portion 57C, the second cam surface 57*b* contacts the lever 60. The control unit 101 is configured to stop the contact/separation motor 51 in this state and execute the image forming operation.

In the mono mode, the space between the developing roller 23C and the photosensitive drum 22C is smaller when the developing unit 71C is located at the small separation position than when the developing unit 71C is located at the separation position. The amount of separation of the developing unit 71C is smaller than the amount of separation of each of the developing units 71Y and 71M (space between the developing roller 23 and photosensitive drum 22).

As illustrated in FIG. 7, the moving speed of the developing unit 71C while the second cam surface 57*b* contacts the lever 60 is slower than the moving speed of the developing unit 71C before and after the second cam surface 57*b* contacts the lever 60.

Figure 11:
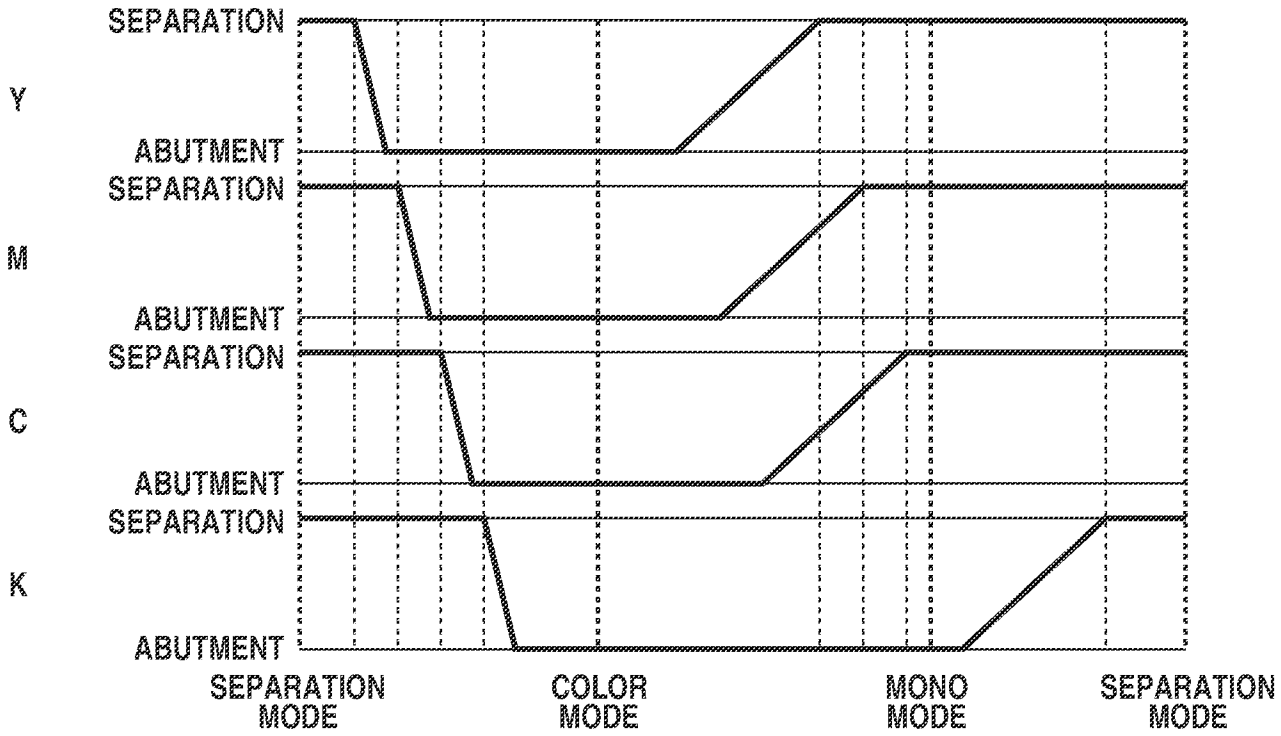
FIG. 11 is a cam diagram illustrating an operation of an image forming apparatus according to a comparative example.

A description is given of the operation of the image forming apparatus 1 according to the present exemplary embodiment and the operation of an image forming apparatus according to a comparative example. FIG. 11 is a cam diagram illustrating the operation of the image forming apparatus according to the comparative example.

As illustrated in FIG. 11, in the image forming apparatus according to the comparative example, in a state where each of the developing units 71Y, 71M, and 71C is located at the separation position, the developing unit 71K starts moving from the contact position to the separation position. In the mono mode according to the comparative example, each of the developing units 71Y, 71M, and 71C is located at the separation position.

To perform the image forming operation in the mono mode, it is necessary to maintain the developing unit 71K at the contact position in the state where the developing units 71Y, 71M, and 71C are separate. If the developing unit 71K is separated immediately after the developing units 71Y, 71M, and 71C separate, it is difficult to perform the image forming operation in the mono mode. Thus, the timing of the separation of the developing unit 71K is delayed, and only the process cartridge PK is brought into the contact state between the color mode and the separation mode. Thus, the time during which the photosensitive drum 23 and the developing roller 22 contact each other (contact time) is longer in the process cartridge PK than in the process cartridges PY, PM, and PC.

In the mono mode of the present exemplary embodiment, each of the process cartridges PY and PM is in the separation state, the process cartridge PC is in the small separation state, and the process cartridge PK is in the contact state. In other words, the image forming apparatus 1 according to the present exemplary embodiment is configured to start moving the developing unit 71K to the separation position before the developing unit 71C reaches the separation position. On the other hand, in the mono mode of the comparative example illustrated in FIG. 11, each of the process cartridges PY, PM, and PC is in the separation state, and the process cartridge PK is in the contact state. In other words, the image forming apparatus according to the comparative example is configured to start moving the developing unit 71K to the separation position after the developing unit 71C reaches the separation position.

More specifically, in the present exemplary embodiment, the image forming apparatus 1 is configured so as to perform the image forming operation in the mono mode, whereby the timing when the developing unit 71K starts moving to the contact position can be put ahead.

In the configuration of the present exemplary embodiment, the positions for the color mode and the mono mode can be brought closer to each other than in the comparative example. More specifically, in the process in which the image forming apparatus 1 changes to the separation mode, the color mode, the mono mode, and the separation mode, the point where the image forming apparatus 1 changes to the color mode and the point where the image forming apparatus 1 changes to the mono mode can be brought close to each other. Thus, the time from when the image forming operation in the color mode ends to when the developing unit 71K starts moving to the separation position can be made shorter than in the comparative example. As a result, in the developing unit 71K, the time during which the state where the developing roller 23 contacts the photosensitive drum 22 is maintained can be made shorter than in the comparative example. In this way, in the developing unit 71K, it is possible to reduce the wearing away of the photosensitive drum 22 and the developing roller 23 and to prevent the deterioration of the photosensitive drum 22 and the developing roller 23.

Further, in the present exemplary embodiment, in the mono mode, the cam portion 57C is in the state where the lever 60 contacts the second cam surface 57*b*. Thus, even in the state before the developing unit 71C reaches the separation position, it is possible to prevent the cam portion 57C from rotating by receiving a force from the lever 60. It is also possible to determine the position of the developing unit 71C with high accuracy. Thus, it is possible to stably execute the image forming operation in the mono mode.

In the present exemplary embodiment, the main driving unit 50 includes a gear train that transmits drive to the development driving units 59Y, 59M, 59C, and 59K that drive the developing rollers 23Y, 23M, 23C, and 23K, respectively. A clutch (not illustrated) is arranged in the gear train. If the developing roller 23 is in the separation state, drive to the developing roller 23 is disconnected. Immediately before the developing roller 23 contacts the photosensitive drum 22, drive to the developing roller 23 is transmitted. Immediately after the developing roller 23 separates from the photosensitive drum 22, drive to the developing roller 23 is disconnected.

In the present exemplary embodiment, the clutch is provided in each of the development driving units 59Y, 59M, 59C, and 59K. Each clutch is coupled to the cam gear 56 (56Y, 56M, 56C, 56K) through a gear (not illustrated). At this time, the clutch is attached so that the timings of a development operation and a separation operation of the developing roller 23 are linked to the timings of the transmission and the disconnection of drive to the developing roller 23.

With this configuration, drive to the developing roller 23 is disconnected except when an image is formed. Thus, it is possible to reduce the total number of rotations of the developing roller 23. It is possible to prevent the wearing away of the developing roller 23 and the supply roller 27 that contacts the developing roller 23 and the deterioration of toner due to the friction between the developing roller 23 and the supply roller 27.

As described above, the image forming apparatus 1 can execute an image forming operation using the process cartridge PK that is a part of the image forming units, and also shorten the time during which the state where the developing roller 23K and the photosensitive drum 22K contact each other is maintained.

A second exemplary embodiment is described. Portions similar to those in the first exemplary embodiment are not described. The second exemplary embodiment is different from the first exemplary embodiment in the timing when the developing unit 71K starts moving to the separation position. The second exemplary embodiment is also different from the first exemplary embodiment in the operation of the developing unit 71M through the color mode to the separation mode.

Figure 8:
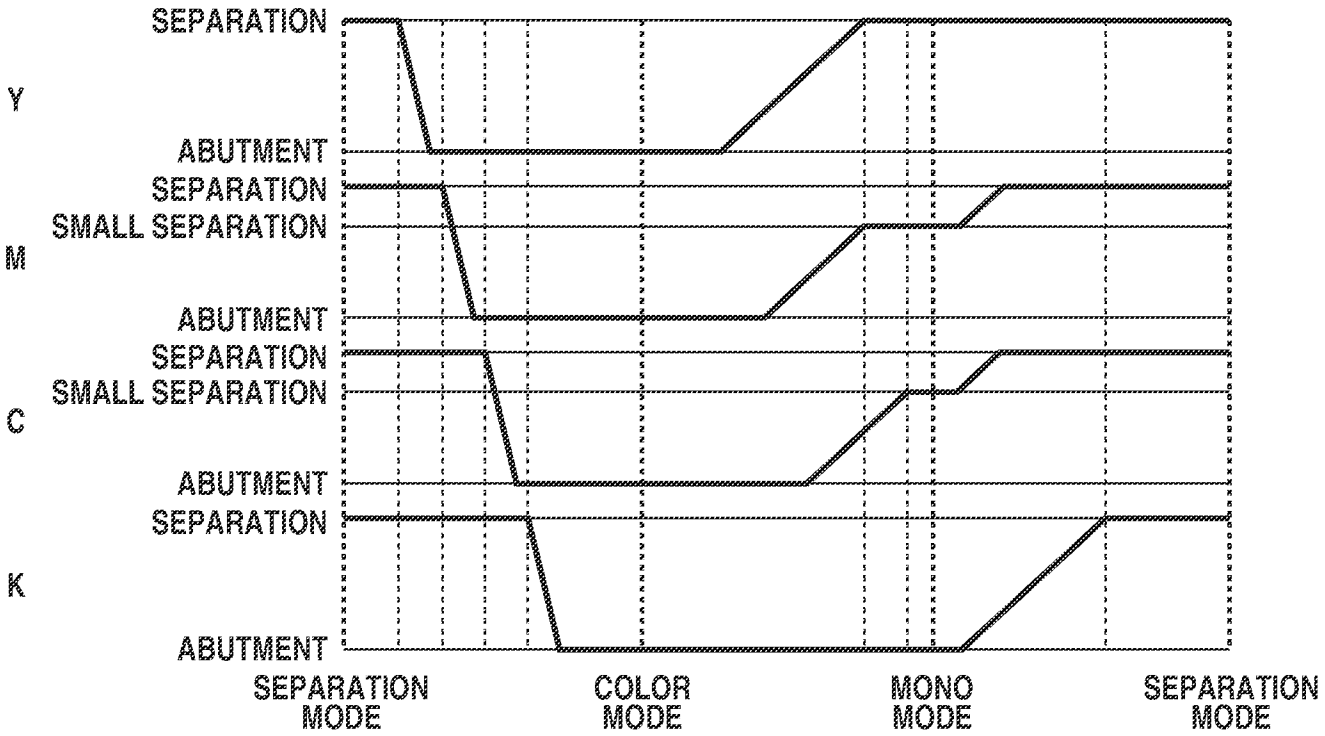
FIG. 8 is a cam diagram illustrating an operation of an image forming apparatus according to a second exemplary embodiment.
Figure 9:
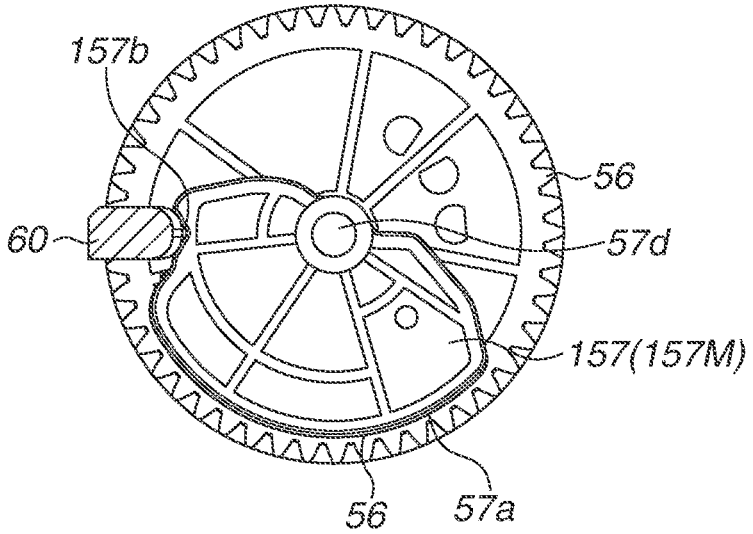
FIG. 9 is a diagram illustrating a relationship between a cam portion and a lever according to the second exemplary embodiment.

With reference to FIG. 8, the operation of the image forming apparatus 1 according to the second exemplary embodiment is described. With reference to FIG. 9, a configuration of a cam portion 157 according to the second exemplary embodiment is described.

FIG. 8 is a cam diagram illustrating the operation of the image forming apparatus 1 according to the second exemplary embodiment. FIG. 9 is a diagram illustrating a relationship between the cam portion 157 and the lever 60 according to the second exemplary embodiment.

Similar to the first exemplary embodiment, after the image forming operation in the color mode ends, the image forming apparatus 1 returns from the color mode through the mono mode to the separation mode.

As illustrated in FIG. 8, each of the developing units 71M and 71C moves through the intermediate position to the separation position. In the present exemplary embodiment, the developing unit 71K is configured to start moving from the contact position to the separation position in a state where each of the developing units 71M and 71C is between the contact position and the separation position.

As illustrated in FIG. 8, in the mono mode according to the present exemplary embodiment, the developing unit 71Y is located at the separation position, and each of the developing units 71M and 71C is located at the small separation position. In other words, each of the developing units 71M and 71C is located at the intermediate position (small separation position) between the contact position and the separation position. The control unit 101 is configured to execute the image forming operation in this state.

The image forming apparatus 1 according to the present exemplary embodiment is configured to start moving the developing unit 71K to the separation position before each of the developing units 71M and 71C reaches the separation position.

As a result, in the configuration of the present exemplary embodiment, the positions for the color mode and the mono mode can be brought even closer to each other. The time from when the image forming operation in the color mode ends to when the developing unit 71K starts moving to the separation position can be made even shorter. As a result, in the developing unit 71K, the time during which the state where the developing roller 23 contacts the photosensitive drum 22 is maintained can be made shorter than in the comparative example. In this way, it is possible to reduce the wearing away of the photosensitive drum 22 and the developing roller 23 and to prevent the deterioration of the photosensitive drum 22 and the developing roller 23.

The second cam surface 57*b* of the cam portion 57C according to the first exemplary embodiment is a surface having an approximately constant distance (radius) from the rotation center 57*d*. The first cam surface 57*a* and the second cam surface 57*b* are arranged in approximately concentric circles.

The image forming apparatus 1 according to the second exemplary embodiment includes the cam portion 157 (157M) at a position corresponding to the cam portion 57M according to the first exemplary embodiment. The shape of the cam portion 157M is different from the shape of the cam portion 57 (57C).

As illustrated in FIG. 9, similar to the cam portion 57, the cam portion 157M includes the first cam surface 57*a*. The cam portion 157M includes a second cam surface 157*b* equivalent to the second cam surface 57*b* according to the first exemplary embodiment. When the image forming apparatus 1 performs the image forming operation in the mono mode, the lever 60 corresponding to the process cartridge PM contacts the second cam surface 157*b*, and the developing unit 71M is located at the intermediate position. The lever 60 corresponding to the process cartridge PC contacts the second cam surface 57*b* of the cam portion 57C, and the developing unit 71C is located at the intermediate position.

The second cam surface 157*b* has a V-shaped recessed shape and sandwiches the lever 60. More specifically, the second cam surface 157*b* includes a first reception surface extending in a direction away from the rotation center 57*d* toward the upstream side of the rotational direction of the cam portion 157, and a second reception surface extending in a direction away from the rotation center 57*d* toward the downstream side of the rotational direction of the cam portion 157. The lever 60 comes into contact with the first and second reception surfaces.

In this case, since the second cam surface 157*b* has a V-shape, when receiving a force from the lever 60, the second cam surface 157*b* receives two forces in the direction in which the cam portion 157M is rotated forward and the direction in which the cam portion 157M is rotated backward. The second cam surface 157*b* is arranged so that these two forces cancel out each other, whereby it is possible to prevent the rotation of the cam portion 157M.

In other words, the movement unit 90 that moves the worm gear 55M, the cam gear 56M, the cam portion 157M, and the developing unit 71M can be said to be a part of the movement mechanism (third movement mechanism or third position regulation mechanism) for moving the developing unit 71M. This movement mechanism regulates the position of the developing unit 71M and enables the developing unit 71M to move to the contact position, the separation position, and the intermediate position.

Alternatively, as the cam portion 157M, a cam portion having the same shape as that of the cam portion 57C according to the first exemplary embodiment can also be used. Alternatively, as the cam portion 57C according to the first exemplary embodiment, a cam portion having the same shape as that of the cam portion 157M can also be used.

As described above, the image forming apparatus 1 can execute an image forming operation using the process cartridge PK that is a part of the image forming units, and also shorten the time during which the state where the developing roller 23K and the photosensitive drum 22K contact each other is maintained.

A third exemplary embodiment is described. Portions similar to those in the first and second exemplary embodiments are not described.

In the first exemplary embodiment, the developing roller 23 is caused to contact the photosensitive drum 22 by the biasing force of the biasing member 65 arranged in the development movement mechanism. In the present exemplary embodiment, the developing roller 23 is caused to contact the photosensitive drum 22 by the biasing force of a cartridge biasing member 173 arranged between the photosensitive unit 70 and the developing unit 71.

Figure 10A:
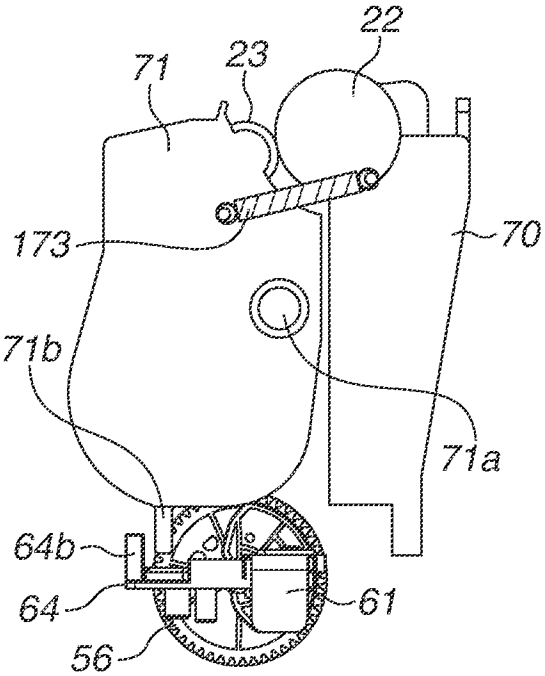
FIGS. 10A, 10B, and 10C are side views respectively illustrating a process cartridge in a state where a developing unit is in a contact state, the process cartridge in a state where the developing unit is in a separation state, and the process cartridge in a state where the developing unit is in an intermediate state.
Figure 10B:
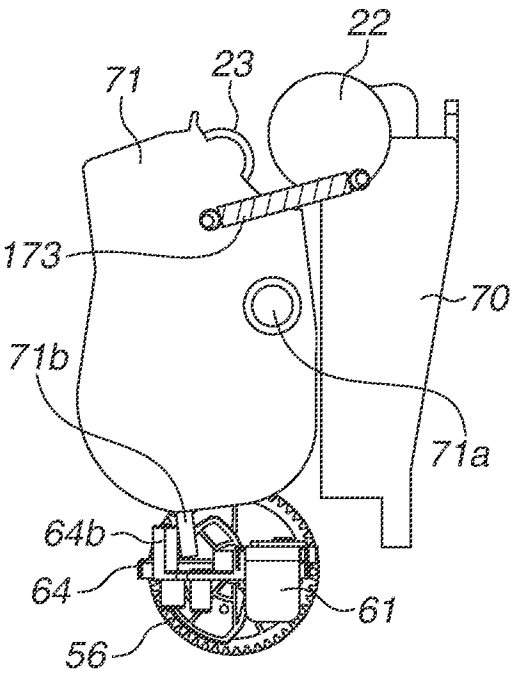
Figure 10C:
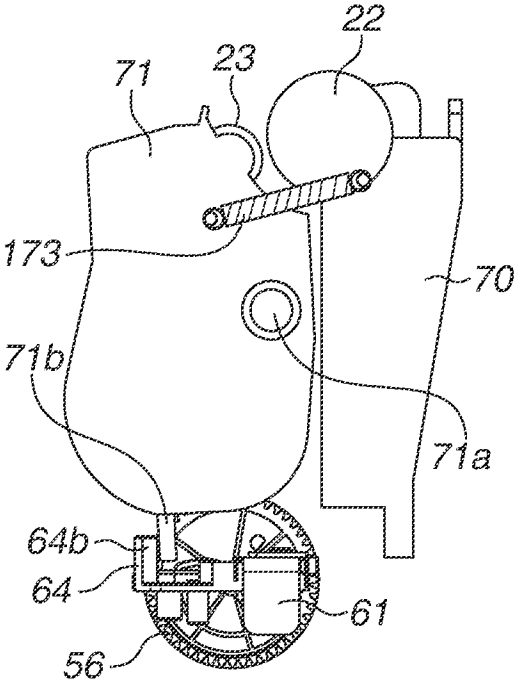

With reference to FIGS. 10A, 10B, and 10C, the relationship between the development movement mechanism and each process cartridge P according to the present exemplary embodiment is described.

FIGS. 10A to 10C, are side views of each process cartridge P according to the present exemplary embodiment. FIG. 10A is a side view of the process cartridge P when the developing unit 71 is in the contact state. FIG. 10B is a side view of the process cartridge P when the developing unit 71 is in the separation state. FIG. 10C is a side view of the process cartridge P when the developing unit 71 is in the intermediate state (small separation state). FIGS. 10A, OB, and IOC are views of the process cartridge P viewed along the rotational axis of the developing roller 23. In the present exemplary embodiment, the rotational axis of the developing roller 23 is parallel to the rotational axis of the photosensitive drum 22 and the rotational axis of the developing unit 71.

As illustrated in FIGS. 10A to 10C, a cartridge biasing member 173 is arranged between the photosensitive unit 70 and the developing unit 71. The developing unit 71 is biased in the clockwise direction by the biasing force of the cartridge biasing member 173, and the developing roller 23 contacts the photosensitive drum 22 (FIG. 10A).

In the present exemplary embodiment, the movement member 64 does not include the pressing portion 64*a* according to the first exemplary embodiment. When the developing roller 23 is separated from the photosensitive drum 22, the separation guarantee portion 64*b* comes into contact with the pressing target portion 71*b*, thereby rotating the developing unit 71 in the counterclockwise direction.

When the developing unit 71 is at the separation position (FIG. 10B) and when the developing unit 71 is at the intermediate position (FIG. 10C), the separation guarantee portion 64*b* and the pressing target portion 71*b* come into contact with each other, whereby the photosensitive drum 22 and the developing roller 23 separate from each other.

Even in a case where such a process cartridge P is used, similar to the first or second exemplary embodiment, the time from when the image forming operation in the color mode ends to when the developing unit 71K starts moving to the separation position can be made shorter than in the comparative example (FIG. 11). Accordingly, in the developing unit 71K, the time during which the developing roller 23 rotates in the state where the developing roller 23 contacts the photosensitive drum 22 can be made shorter than in the comparative example. In this way, it is possible to reduce the wearing away of the photosensitive drum 22 and the developing roller 23 and to prevent the deterioration of the photosensitive drum 22 and the developing roller 23.

<Modified Example>

Each of the exemplary embodiments is configured to perform the image forming operations in the order of the process cartridges PY, PM, PC, and PK. However, the order of the image forming operations is not limited to this order. For example, a configuration in which the image forming operations are performed in the order of the process cartridges PK, PC, PM, and PY, may be employed. The operations of the process cartridges PK, PC, PM, and PY in this case are performed following the cam diagrams illustrated in FIGS. 7, 8, and II from right to left in the figures. More specifically, the image forming apparatus 1 changes to the separation mode, the mono mode, and the color mode in this order.

The states of the process cartridges PK, PC, PM, and PY in the mono mode, the color mode, and the separation mode are similar to those illustrated in each of the exemplary embodiments.

More specifically, in a case where the image forming apparatus 1 changes from the separation mode to the mono mode, and when the developing unit 71K is located at the contact position, the developing unit 71C or each of the developing units 71C and 71M is located between the separation position and the contact position.

Also in this case, the process cartridge PC or each of the process cartridges PC and PM shifts through the small separation state to the color mode, whereby the positions for the color mode and the mono mode can be brought close to each other. Thus, it is possible to shorten the time during which the state where the developing roller 23K contacts the photosensitive drum 22K is maintained.

According to the present disclosure, it is possible to provide an image forming apparatus capable of executing an image forming operation using a part of image forming units, and shortening the time during which the state where a developing roller and a photosensitive drum contact each other is maintained.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-215828, filed Nov. 28, 2019, which is hereby incorporated by reference herein in its entirety.

What is claimed is:

1. An image forming apparatus comprising:

a first image forming unit having a first drum unit including a first photosensitive drum, and a first developing unit including a first developing roller configured to contact the first photosensitive drum;

a second image forming unit having a second drum unit including a second photosensitive drum, and a second developing unit including a second developing roller configured to contact the second photosensitive drum;

a first movement mechanism configured to move the first developing unit so that the first developing unit is located at a first contact position where the first developing roller contacts the first photosensitive drum, and at a first separation position where the first developing roller is separate from the first photosensitive drum;

a second movement mechanism configured to move the second developing unit so that the second developing unit is located at a second contact position where the second developing roller contacts the second photosensitive drum, at a second separation position where the second developing roller is separate from the second photosensitive drum, and at an intermediate position between the second contact position and the second separation position; and a control unit configured to execute a first image forming operation in a state where the first developing roller contacts the first photosensitive drum, and the second developing roller is separate from the second photosensitive drum, wherein the first movement mechanism is configured to start moving the first developing unit from the first contact position to the first separation position in a state where the second developing unit is located between the second contact position and the second separation position.

2. The image forming apparatus according to claim 1, wherein the control unit is configured to execute the first image forming operation in a state where the second developing unit is located at the intermediate position.

3. The image forming apparatus according to claim 2, further comprising a third image forming unit having a third photosensitive drum, and a third developing unit including a third developing roller configured to contact the third photosensitive drum, wherein the control unit is configured to execute the first image forming operation in a state where the third developing roller is separate from the third photosensitive drum.

4. The image forming apparatus according to claim 3, further comprising a third movement mechanism configured to move the third developing unit so that the third developing unit is located at a third contact position where the third developing roller contacts the third photosensitive drum, a third separation position where the third developing roller is separate from the third photosensitive drum, and an intermediate position between the third contact position and the third separation position, wherein the control unit is configured to execute the first image forming operation in a state where the third developing unit is located at the intermediate position between the third contact position and the third separation position.

5. The image forming apparatus according to claim 1, wherein the second movement mechanism includes a movement member configured to come into contact with the second developing unit, a cam portion configured to rotate, and a coupling portion configured to couple the movement member and the cam portion, and wherein the cam portion includes a first cam surface and a second cam surface, and when the coupling portion comes into contact with the first cam surface, the second developing unit is located at the second separation position, and when the coupling portion comes into contact with the second cam surface, the second developing unit is located at the intermediate position between the second contact position and the second separation position.

6. The image forming apparatus according to claim 5, wherein the second cam surface has an arc shape.

7. The image forming apparatus according to claim 6, wherein a center of the arc shape coincides with a rotation center of the cam portion.

8. The image forming apparatus according to claim 5, wherein the second movement mechanism includes a biasing member configured to bias the movement member toward the second developing unit.

9. The image forming apparatus according to claim 1, wherein the second image forming unit includes a biasing member, and wherein the biasing member biases the second developing unit so that the second developing roller contacts the second photosensitive drum.

10. The image forming apparatus according to claim 1, wherein the first image forming unit is arranged adjacent to the second image forming unit.

11. An image forming apparatus comprising:

a first image forming unit having a first drum unit including a first photosensitive drum, and a first developing unit including a first developing roller configured to contact the first photosensitive drum;

a second image forming unit having a second drum unit including a second photosensitive drum, and a second developing unit including a second developing roller configured to contact the second photosensitive drum;

a first movement mechanism configured to move the first developing unit so that the first developing unit is located at a first contact position where the first developing roller contacts the first photosensitive drum, and a first separation position where the first developing roller is separate from the first photosensitive drum;

a second movement mechanism configured to move the second developing unit so that the second developing unit is located at a second contact position where the second developing roller contacts the second photosensitive drum, a second separation position where the second developing roller is separate from the second photosensitive drum, and an intermediate position between the second contact position and the second separation position; and a control unit configured to execute a first image forming operation in a state where the first developing roller contacts the first photosensitive drum, and the second developing roller is separate from the second photosensitive drum, wherein the control unit is configured to execute the first image forming operation in a state where the second developing unit is located at the intermediate position.

12. The image forming apparatus according to claim 11, further comprising a third image forming unit having a third photosensitive drum, and a third developing unit including a third developing roller configured to contact the third photosensitive drum, wherein the control unit is configured to execute the first image forming operation in a state where the third developing roller is separate from the third photosensitive drum.

13. The image forming apparatus according to claim 12, further comprising a third movement mechanism configured to move the third developing unit so that the third developing unit is located at a third contact position where the third developing roller contacts the third photosensitive drum, a third separation position where the third developing roller is separate from the third photosensitive drum, and an intermediate position between the third contact position and the third separation position, wherein the control unit is configured to execute the first image forming operation in a state where the third developing unit is located at the intermediate position between the third contact position and the third separation position.

14. The image forming apparatus according to claim 11, wherein the second movement mechanism includes a movement member configured to come into contact with the second developing unit, a cam portion configured to rotate, and a coupling portion configured to couple the movement member and the cam portion, and wherein the cam portion includes a first cam surface and a second cam surface, and when the coupling portion comes into contact with the first cam surface, the second developing unit is located at the second separation position, and when the coupling portion comes into contact with the second cam surface, the second developing unit is located at the intermediate position between the second contact position and the second separation position.

15. The image forming apparatus according to claim 14, wherein the second cam surface has an arc shape.

16. The image forming apparatus according to claim 15, wherein a center of the arc shape coincides with a rotation center of the cam portion.

17. The image forming apparatus according to claim 14, wherein the second movement mechanism includes a biasing member configured to bias the movement member toward the second developing unit.

18. The image forming apparatus according to claim 11, wherein the second image forming unit includes a biasing member, and wherein the biasing member biases the second developing unit so that the second developing roller contacts the second photosensitive drum.

19. The image forming apparatus according to claim 11, wherein the first image forming unit is arranged adjacent to the second image forming unit.

* * * * *